340-552 SR

11/6/84 XR 4,481,516

United States Patent [19]

Michelotti

[11] Patent Number: 4,481,516

[45] Date of Patent: Nov. 6, 1984

[54] LOW VISIBILITY RUNWAY MONITOR

[76] Inventor: Paul E. Michelotti, 59 Bob Hill Rd., Ridgefield, Conn. 06877

[21] Appl. No.: 428,196

[22] Filed: Sep. 29, 1982

Related U.S. Application Data

[63] Continuation-in-part of Ser. No. 201,009, Oct. 27, 1980, abandoned, which is a continuation-in-part of Ser. No. 949,436, Dec. 14, 1978, abandoned.

[51] Int. Cl.[3] ..... G08G 1/01; G08B 13/18

[52] U.S. Cl. ..... 340/933; 340/953; 340/552

[58] Field of Search ..... 340/38 R, 38 P, 38 S, 340/552, 553, 26, 27 R, 933, 947, 942, 943, 953; 377/9; 343/17.7, 5 PD

[56] References Cited

U.S. PATENT DOCUMENTS

| | | | |
|---|---|---|---|
| 1,885,023 | 10/1932 | Dieckmann | 340/26 |
| 2,051,194 | 8/1936 | Adler | 340/31 R |
| 2,131,032 | 9/1938 | Barbulesco | 340/26 |
| 2,649,538 | 8/1953 | Marlowe et al. | 340/552 |
| 3,152,315 | 10/1964 | Rodgers | 340/38 R |
| 3,422,431 | 1/1969 | Hafner | 340/552 |
| 3,872,474 | 3/1975 | Levine | 343/5 LS |
| 3,971,025 | 7/1976 | Levine | 340/26 |
| 4,023,017 | 5/1977 | Ceseri | 340/38 R |
| 4,079,361 | 3/1978 | Woode | 340/553 |
| 4,219,802 | 8/1980 | Ceseri | 340/38 R |
| 4,302,746 | 11/1981 | Scarzello et al. | 340/38 R |

*Primary Examiner*—James J. Groody
*Attorney, Agent, or Firm*—Eugene M. Cummings; Joseph Levinson; Charles F. Gunderson

[57] ABSTRACT

A runway collision avoidance system having warning devices is provided for the safety of aircraft taxiing, taking off, and landing. The system is capable of detecting ground traffic and obstacles including aircraft, maintenance vehicles and wildlife that may encroach upon an active runway during low visibility conditions or when visual observation is impaired. The system includes an electromagnetic transmitter positioned beyond one end of a runway which directs a continuous beam of high frequency radio signals, for example microwaves, longitudinally along the full length of the runway. A plurality of electromagnetic receivers positioned beyond the other end of the runway pick up the transmitted signals and apply them to a balance circuit and then to a comparator circuit. With a clear runway, the transmitted signals are received without interruption and the receiver outputs remain balanced or equal. However, should an obstruction occur on the runway, an attenuation is produced in one or more of the receivers and a warning output is generated by the comparator circuit. The comparator warning output is utilized to activate aural and visual indicators in the control tower as well as warning lights positioned at appropriate points near the runway.

3 Claims, 1 Drawing Figure

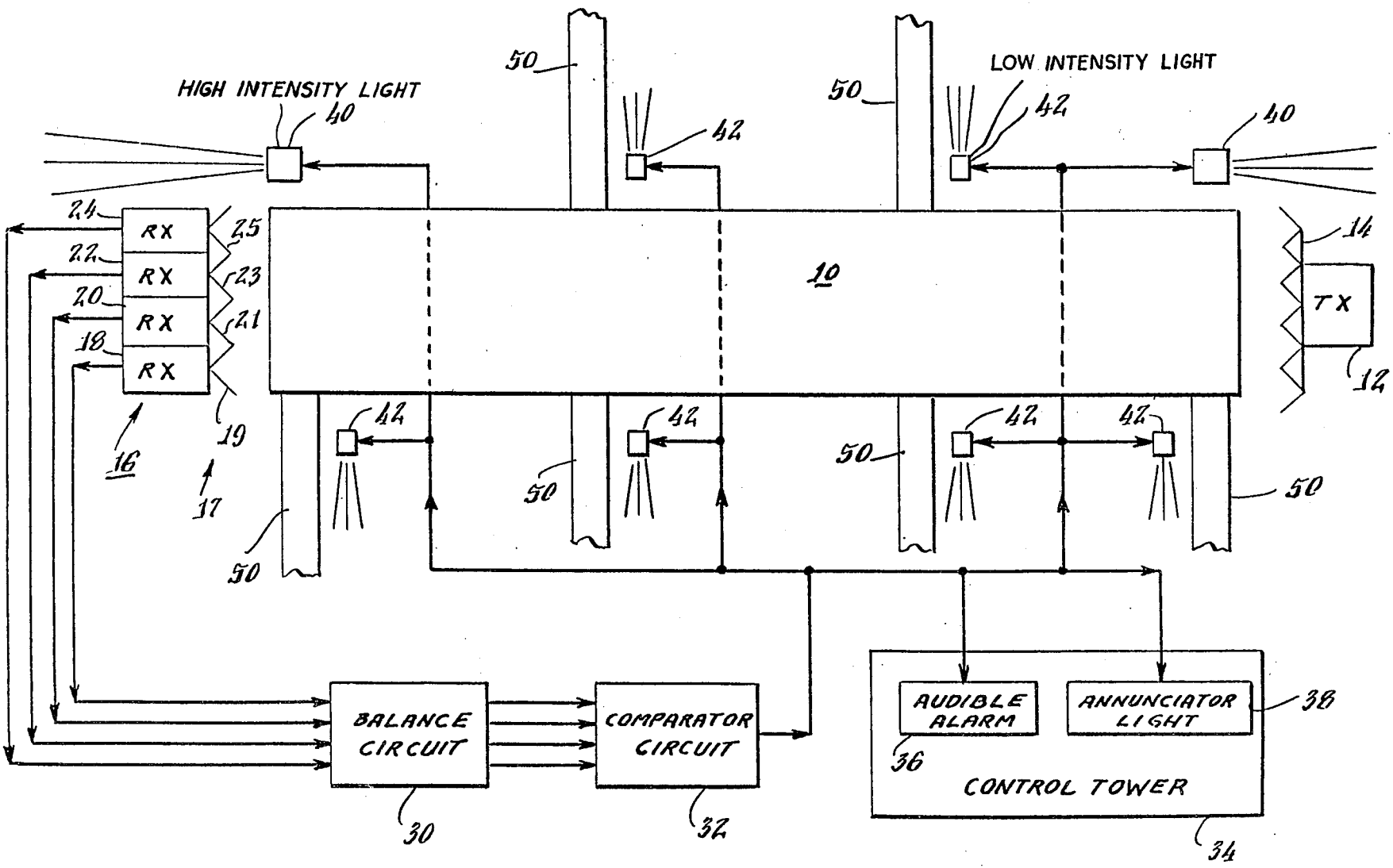
LOW INTENSITY LIGHT
HIGH INTENSITY LIGHT
TX
RX
RX
RX
RX
ANNUNCIATOR LIGHT
AUDIBLE ALARM
CONTROL TOWER
COMPARATOR CIRCUIT
BALANCE CIRCUIT
10
12
14
16
17
18
19
20
21
22
23
24
25
30
32
34
36
38
40
42
50

LOW VISIBILITY RUNWAY MONITOR

RELATED APPLICATIONS

This application is a continuation-in-part of application Ser. No. 06/201,009 filed Oct. 27, 1980 which is a continuation-in-part of application Ser. No. 949,436 filed Dec. 14, 1978, both abandoned.

BACKGROUND OF THE INVENTION

This invention relates to a runway collision avoidance system which monitors a runway to detect obstructions therein and to warn aircraft and the control tower when an obstruction is present on an active runway.

During low-visibility conditions, it is often impossible for either pilots or air traffic-controllers to visually inspect or observe an active runway for the presence of aircraft or ground vehicles. Under such conditions it is generally accepted practice to assume that all taxiing aircraft and ground vehicles are proceeding in compliance with proper ground control or tower control clearances. Due to the complexity of most modern airports, however, the possibility of operational errors is always present and is significantly increased during low-visibility conditions when landmarks and reference points are obscured from vision. When an error or misunderstanding does occur, the results can be catastrophic.

On Mar. 27, 1977, during low-visibility conditions at Tenerife Airport, Canary Islands, the worst disaster in the history of commercial aviation occurred when a KLM B747 collided during takeoff with a Pan American B747 which was taxiing on the runway. Five hundred eighty-one lives were lost. A similar accident occurred at Chicago O-Hare Airport in December, 1972, also with tragic results. These and numerous other accidents and incidents clearly indicate the need for a positive means of runway traffic detection.

The encroachment of wildlife onto a runway also presents a hazard. As recently as Aug. 28, 1982, a U.S. Air DC-9 was seriously damaged during take-off when it struck a deer which had wandered onto the active runway at Pittsburg International Airport.

A more recent need for an automatic runway monitoring and detection system arises from the Federal Aviation Administration's decision to close airport control towers at many of the nation's major airports during the late evening and early morning hours. For example, New York LaGuardia Airport, one of the most congested facilities in the country, and the site of several near collisions in recent years, no longer provides tower control during the hours of 0100 to 0600 local while leaving the airport runways open to both arrivals and departures without restriction to published operating minimums.

SUMMARY OF THE INVENTION

Accordingly, it is an object of the present invention to provide a runway collision avoidance system which monitors a given runway for the presence of aircraft, vehicles or other obstructions and which provides a warning to both the control tower and aircraft in the vicinity of the runway when such presence is detected.

A further object of this invention is to provide a runway collision avoidance system which can be adapted to existing runways without the need for major airport alterations.

Another object of the present invention is to provide a runway collision avoidance system which will provide an automatic warning of obstructions to aircraft operating at airports where control towers are closed.

In carrying out this invention, in one embodiment an electromagnetic transmitter positioned at one end of a runway directs a continuous beam of signals longitudinally along the full length of the runway. A plurality of electromagnetic receivers positioned across the opposite end of the runway pick up the transmitted signals and apply them to a balance circuit. The balance circuit equalizes the output of each receiver and maintains said equalization automatically and continuously in the absence of an obstruction on the runway. However, the balance circuit is designed with limited adjustment capability so that abrupt voltage changes caused by the introduction of an obstruction on the runway will exceed said adjustment capability and be detected by a comparator circuit. The comparator circuit, upon sensing an imbalance in receiver strengths, produces a warning output which actuates audible and visual signals in the control tower as well as warning lights positioned at appropriate points near the runway.

BRIEF DESCRIPTION OF THE DRAWING

The drawing is a schematic block diagram illustrating the present invention monitoring a runway.

DESCRIPTION OF THE PREFERRED EMBODIMENTS

Referring now to the drawing, the main runway 10 is illustrated being monitored by a transmitter 12 having an antenna array 14 which covers the entire width of the runway and directs signals down the runway. The signals are picked up by a receiver antenna array 17 and a receiver array, referred to generally with the reference numeral 16. The antenna array 17 covers the entire width of the runway. The receiver array 16 includes a plurality of receivers 18, 20, 22 and 24 along with their associated antennas 19, 21, 23 and 25, respectively, making up the receiver antenna array 17.

The transmitter preferably transmits a continuous beam of electromagnetic radiation in the high frequency range, preferably microwaves, which travel only short distances and will not interfere with the variety of frequency bands and other electronic equipment utilized in and around airports. By continuous beam either a CW or a modulated or interrupted beam of electromagnetic radiation may be utilized as long as it is continually being transmitted and is capable of being monitored by the array of receivers 16. Discontinuous transmissions for periods of time would not be suitable to continuously monitor the runways. The antenna array 14 of the transmitter should provide a certain amount of directivity so that the transmitter energy is directed toward and received by the receiver antenna array 17.

The receivers 18, 20, 22 and 24 of the receiver array 16 have their outputs supplied to a balance circuit 30 which functions to equalize the outputs of the receiver array when there is no obstruction or interference with the transmitted wave from the transmitter 12. The balance circuit 30 also functions to equalize outputs from the receiver array 16 which may be caused by gradual changes in atmospheric conditions as well as electronic changes in the amplification and detection of signals in the individual receivers 18, 20, 22 and 24.

The balance circuit 30 may consist of parallel servo driven rheostats controlled by voltage level detector circuits. The servo driven rheostats should have very low speed drives which can produce gradual resistance changes in response to minor and gradual changes in voltage levels, but which cannot filter out abrupt voltage changes caused by obstructions introduced onto the runway. The servo functions must be switched off automatically by comparator circuit 32 output, thereby preventing erroneous adjustments during periods of obstruction.

The output of the balance circuit 30 is coupled to a comparator circuit 32 which receives the adjusted receiver outputs from the receiver array 16. Circuit 32 provides a signal when one or more of the outputs from the receivers 18, 20, 22 and 24 varies beyond a predetermined threshhold caused by the introduction or appearance of an obstruction on the runway 10.

The comparison function may advantageously be performed by a digital computer including a memory storing interference patterns corresponding to various known forms of obstructions. The computer, in addition to providing a raw warning output, could also compare an existing interference pattern to the stored data and provide an indication of the probable cause of the warning signal. For example, a slight attenuation in a single receiver might be interpreted as organic matter such as wildlife or a person. A moderate attenuation changing sequentially from receiver to receiver could be interpreted as a vehicle crossing the runway. Strong and symmetrical attentuations in all receivers might suggest that a transport category aircraft is positioned longitudinally on the runway. The probable cause of each obstruction warning could be presented by an electronic display (not shown) located in the control tower.

Various alarm means are provided which are connected to the output of the comparator circuit 32. The control tower 34 includes an audible alarm 36 as well as a visual indicator light 38 indicating that an obstruction is in the runway. The comparator circuit 32 is also connected to high intensity warning lights 40 positioned at the ends of the runway 10 and directed outwardly therefrom and along the glide slope. Also, a plurality of lower intensity lights 42 are connected to the output of the comparator 32 and are located along the taxiways 50 and are directed down the taxiways to warn vehicles or aircraft approaching on the taxiways that the runway 20 contains an obstruction in some form.

In operation, the transmitter 12 sends a continuous beam of electromagnetic radiation down the runway 10 which is picked up by the antenna array 17 of the receiver array 16. The outputs of the receiver array are applied to the balance circuit 30 which adjusts the outputs to a common level when there is a clear line of sight between the transmitter 12 and the receiver array 16. Should an obstruction occur on the runway in the form of a vehicle or an aircraft, the output of one of the receivers 18, 20, 22 or 24 or the outputs of more than one of them will be affected. However, it is virtually impossible for an obstruction to cause equal interference in all of the receivers of the array 16. It will also be apparent that whether the obstruction appears when the system is in operation or when it is first turned on (for example in early morning when the field is just opening), the system will operate to indicate that obstructions appear on the runways.

When an obstruction appears, the unbalanced signals from the balance circuit 30 are applied to the comparator circuit 32 which provides a signal from the audible alarm 36 in the control tower 34 as well as a visual signal from the annunciator light 38. At the same time the high intensity beams 40 will be activated, warning incoming traffic. In addition, low intensity lights 42 will be lit which are directed down the taxiways 50 to indicate to traffic approaching the runway from the ground that there is an obstruction on the runway 10.

The low-visibility runway monitor may be utilized in combination with "Airport Surface Detection Equipment" (radar) presently installed at most major airports. Under this arrangement, the runway monitor would provide an automatic warning of an obstruction and A.S.D.E. could be utilized to examine and further evaluate the cause of such warning.

The greatest value of this system, however, now appears to be at airports where control towers are being closed during the late night and early morning hours.

Other changes and modifications, varied to fit particular operating requirements and environments will be apparent to those skilled in the art. Accordingly, the invention is not limited to the examples chosen for purposes of illustration, and covers all changes and modifications which do not constitute a departure from the true spirit and scope of this invention.

What is claimed is:

1. A runway collision avoidance system for use in conjunction with a runway of the type having an elongated landing surface including an approach end, and at least one intersecting taxiway, and defining an aircraft approach path extending from the approach end along the axis of the runway, for providing a warning to aircraft when an obstruction is on the runway, comprising:

an electromagnetic wave transmitter having an antenna array positioned beyond one end of the runway, said antenna array being positioned to horizontally cover substantially the full width of the runway, said transmitter and antenna array directing electromagnetic wave energy substantially across the entire width and longitudinally along the entire length of the runway;

a plurality of electromagnetic wave receivers each having an antenna arranged in a horizontal array at the other end of the runway which covers substantially the entire width of the runway, said array receiving electromagnetic wave energy directed down said runway by said transmitter;

balance circuit means coupled to the outputs of said receivers for adjusting the outputs of said receivers to a common value in the absence of an obstacle on the runway;

comparator circuit means coupled to said balance circuit means for generating a warning signal when the output of one or more of said receivers varies beyond a predetermined amount from said common value due to the presence of an obstacle on the runway; and light indicator means responsive to said warning signal for providing an indication that an obstruction is present on the runway.

2. A runway collision avoidance system as defined in claim 1 wherein said light indicator means comprise at least one high intensity warning light positioned near the approach end of the runway, directed toward and viewable from the aircraft approach path.

3. A runway collision avoidance system as defined in claim 1 wherein said light indicator means further comprise at least one low intensity warning light positioned at the intersection of the taxiway and the runway and viewable from the taxiway, said low intensity light being coupled to and actuated by said comparator circuit means.

* * * * *